US006461187B2

(12) United States Patent
Chen

(10) Patent No.: US 6,461,187 B2
(45) Date of Patent: Oct. 8, 2002

(54) CONNECTOR ASSEMBLY HAVING AN INTERLOCKING SYSTEM

(75) Inventor: Ping Chen, West Bloomfield, MI (US)

(73) Assignee: J.S.T. MFG. Co., Ltd., Osaka (JP)

( * ) Notice: Subject to any disclaimer, the term of this patent is extended or adjusted under 35 U.S.C. 154(b) by 0 days.

(21) Appl. No.: 10/006,127

(22) Filed: Dec. 10, 2001

(65) Prior Publication Data

US 2002/0072265 A1 Jun. 13, 2002

(30) Foreign Application Priority Data

Dec. 12, 2000 (JP) ..... 2000-376949

(51) Int. Cl.[7] ..... H01R 13/627

(52) U.S. Cl. ..... 439/358; 439/378; 439/680

(58) Field of Search ..... 439/350, 351, 439/352, 354, 355, 357, 358, 378, 680

(56) References Cited

U.S. PATENT DOCUMENTS 4,657,331 A * 4/1987 Coldren ..... 439/357
5,378,168 A * 1/1995 Sumida ..... 439/358
5,775,932 A * 7/1998 Saito et al. ..... 439/358
6,325,656 B1 * 12/2001 Fukuda et al. ..... 439/358

* cited by examiner

*Primary Examiner*—Hien Vu
(74) *Attorney, Agent, or Firm*—Antonelli, Terry, Stout & Kraus, LLP

(57) ABSTRACT

A connector assembly has a male housing (3), a female housing (4) and an interlocking system composed of a lockable lug (7) on the male housing. A lock arm (15) on the female housing has a pawl (16) engaging with the lug, a pair of elastically deforming hinge-shaped legs (17) integrally support the lock arm, and a push lever (18) is disposed at the rear end of lock arm extending rearwards beyond the legs. A guide tongue (10) intervening between a pair of side slots (11) and protruding forwards from the lug (7) is inserted in between the legs (17) spaced sideways, the slots (11) fitting on the legs at the same time. A pair of bridges (19) continue from the female housing (4) to lateral ends of the push lever.

3 Claims, 6 Drawing Sheets

CONNECTOR ASSEMBLY HAVING AN INTERLOCKING SYSTEM

BACKGROUND OF THE INVENTION

The present invention relates to a connector assembly that has an interlocking system for latching a male connector fitted on and engaging with a female connector.

PRIOR ART

Many types of connector assemblies each having an interlocking system of this kind are known in the art. The present invention is directed in particular to such an assembly as comprising a male connector housing (hereinafter simply called 'male housing') and a female connector housing (hereinafter simply called 'female housing'). The male housing has a lockable lug formed on the outer surface thereof, with the female housing has a lock arm that is formed integral with a pawl capable of engaging with the lockable lug. Elastically deforming hinge-shaped legs secure the lock arm to the outer surface of the female housing, which has also a push lever formed on the rear end of its lock arm and disposed in rear of the hinge-shaped legs.

The interlocking portions of the male and female connectors in the described prior art structure are not necessarily sufficient in their mutual retention and in their own mechanical strength. This is because the hinge-shaped legs connecting the lock arm to the female housing are comparatively weak. The prior art structure has rendered unstable its interlocking state, often failing to ensure reliable electrical connections, when used in certain vibrating machines such as automobiles. 'Snap-fit' feeling has also been insufficient when engaging the lockable lug with the lock arm, making it difficult to confirm their mutual connection from outside. Additionally, the handling and pulling of wire ends around the female connector has sometimes imparted such a distortion to the female housing as causing disengagement of the lock arm from the lockable lug. The mutual retention and mechanical strength of those lug and arm in the connectors may be reinforced to a considerable degree. However, this would result in another problem that they could not easily engage with and not smoothly disengage from each other.

A gap is present between the female housing outer surface and the push lever that is formed as a rear end portion of the lock arm. Due to such a gap, electric wire ends belonging to an adjacent harnesses have often pressed undesirably the push lever to unlock the lockable lug out of the lock arm. This drawback has been most prominent in case of arranging a number of wire ends within a narrow space such as those available in automobiles. In addition, electric wire ends of the neighboring harnesses have sometimes got in the gap to be jammed therein, accidentally catching the push lever and hindering the wiring operations.

The prior art assemblies each having the described interlocking system and having their connectors mated have been of such an overall length considerably great to render them larger in size.

SUMMARY OF THE INVENTION

The present invention was made in view of the drawbacks inherent in the prior art structure. An object of the invention is therefore to provide an improved connector assembly comprising a male and a female housing that are designed to moderately reinforce mutual retention and raise mechanical strength of them engaging with each other. The present improvement has also to be such that foreign wires belonging to an adjacent harness are surely protected from being got caught in a push lever that is provided as one of parts constituting an interlocking system in the connector assembly.

Another object is to provide the connector assembly further improved to be of a reduced overall length in a state of their connectors engaging with each other, thus rendering the assembly smaller in size and more resistant to external forces such as one prizing or wrenching its interlocking system.

In order to achieve these objects, the present invention provides a connector assembly composed of connectors and having an interlocking system, the connectors being a male connector having a housing (viz., male housing) and a female connector having another housing (viz., female housing) to be fitted thereon. The interlocking system comprises a lockable lug formed on an outer surface of the male housing, and a lock arm integral with a pawl corresponding to and engageable with the lockable lug, the lock arm being formed on an outer surface of the female housing. The interlocking system further comprises a pair of elastically deforming hinge-shaped legs each having one end integral with the female housing outer surface and also having another end continuing from the lock arm, in addition to a push lever having lateral ends formed integral with a rear end of the lock arm extending rearwardly beyond the pair of hinge-shaped legs. Characteristically, the male housing further comprises a guide tongue protruding forwards from the lockable lug and intervening between side slots, such that the guide tongue is capable of insertion in between the two hinge-shaped legs spaced sideways from each other in the female housing, with the side slots fitting on these legs. A pair of bridges continue from opposite side walls of the female housing so as to be integral with lateral ends of the push lever.

Preferably, each of the bridges disposed beside the push lever may be of a curved shape.

In detail, the male housing of the male connector may be regarded as a box of a rectangularly-parallelepiped shape, and a plurality of pin contacts held in this connector protrude into a cavity that is defined in the box so as to have a fore end opening. On the other hand, the female housing of the female connector is also a parallelepiped fitting in the cavity of male housing, and a plurality of compartments is formed in the female housing so as to correspond to the pin contacts. Socket contacts secured on the ends of respective wires are accommodated in the respective compartments to be isolated from each other. Preferably, the hinge-shaped legs of the female in housing are located inside the respective and corresponding bridges continuing to the lateral ends of the push lever so as to match the side slots.

In the above interlocking structure, the hinge-shaped legs and the pair of bridges may be designed to be of a moderate bending strength (elasticity) in order that rigidity of the lock arm as well as mutual retention and mechanical strength of the housings in their latched state. The pair of bridges will guard the push lever so that any adjacent foreign wire ends will no longer catch or move the push lever, thus protecting the lock arm from any unintentional disengagement from the lockable lug. Further, the guide tongue jutting from this lug will be inserted in between the hinge-shaped legs, with the side slots fitting thereon. This feature is advantageous in that the present assembly of the connectors is smaller in overall length when they are engaged with each other, further rendering the assembly more resistant to external forces such as a prizing or wrenching one.

THE PREFERRED EMBODIMENTS

Now some embodiments of the present invention will be described with reference to the drawings.

Figure 1:
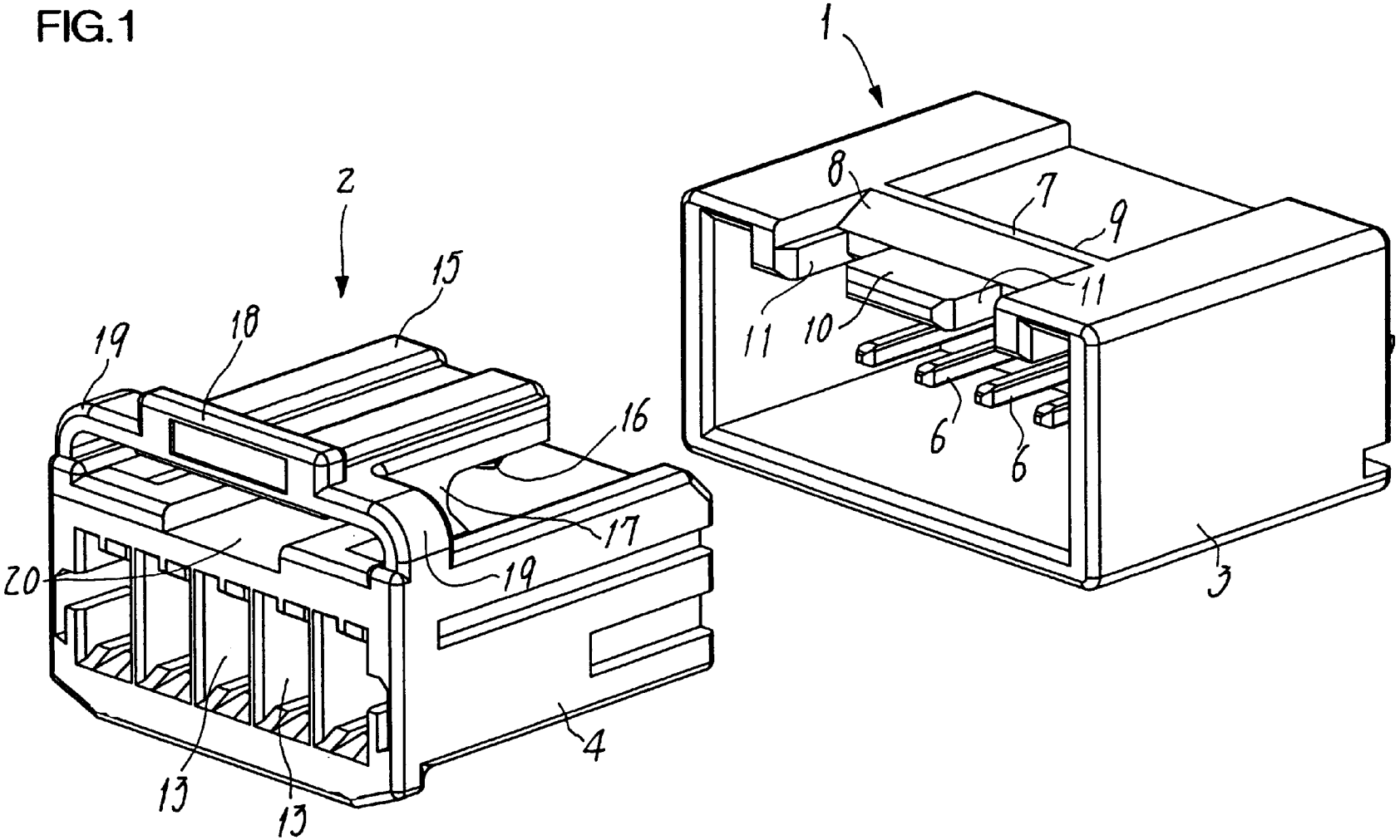
FIG. 1 is a perspective view of a connector assembly provided herein to have an interlocking system, the view showing principal parts or portions of the assembly.
Figure 6:
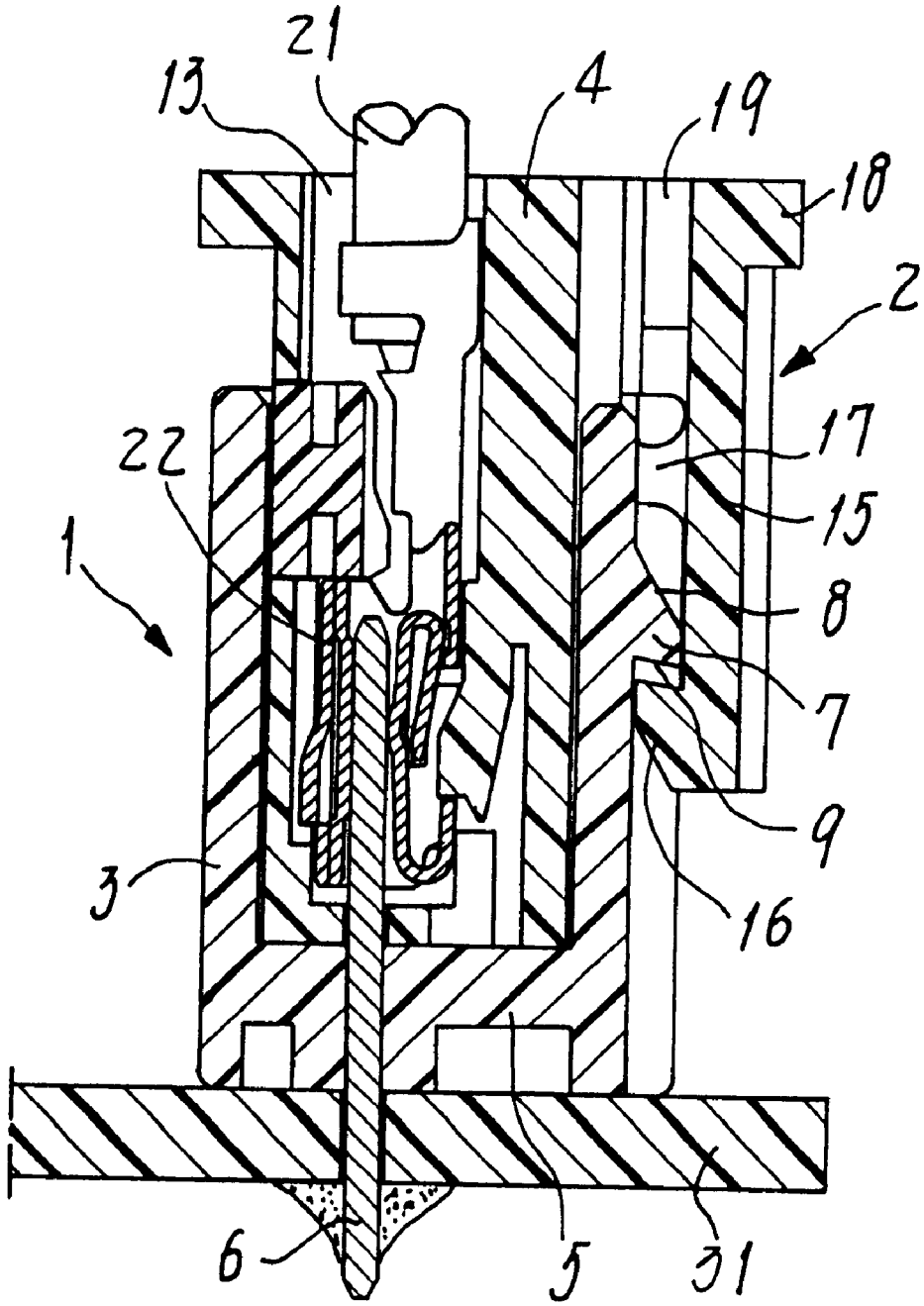
FIG. 6 is a vertical cross section of the connector assembly in use.

FIG. 1 shows a connector assembly of the invention having an interlocking system. This assembly is composed of a pair of connectors that are a male connector 1 and a female connector 2 to be fitted thereon. The male connector 1 comprises its own housing (viz., male housing) 3, with the female connector 2 likewise comprising its own housing (viz., female housing) 4. Both the housings 3 and 4 are made of an insulating resin such as Nylon (a registered trademark). Socket contacts 22 fixed in the female housing 4 are separated from each other to form the female connector 2, although only this housing 4 is shown in FIG. 1. As seen in FIG. 6, electric wire ends 21 are secured in the respective socket contacts 22.

Figure 2:
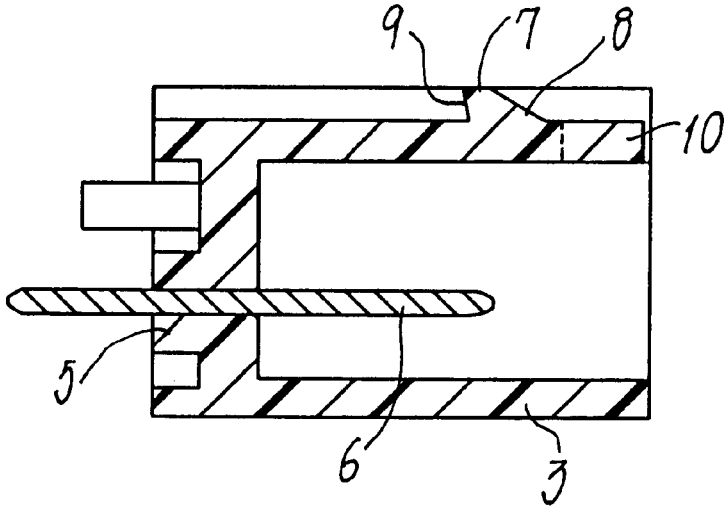
FIG. 2 is a vertical and side-elevational cross section of a male housing included in the assembly.
Figure 3:
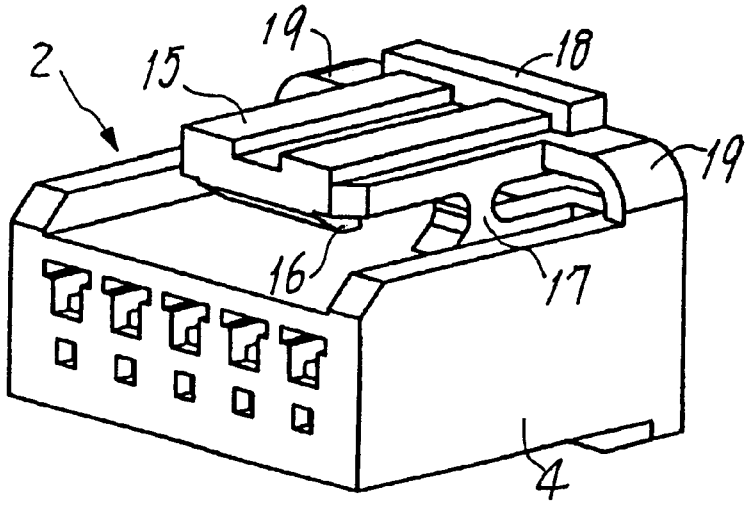
FIG. 3 is a frontal perspective view of a female housing also included in the assembly.
Figure 4:
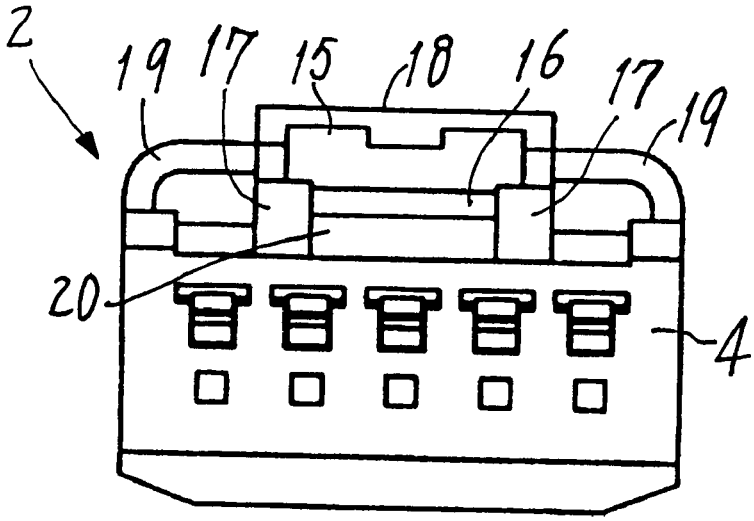
FIG. 4 is a front elevation of the female housing.
Figure 5:
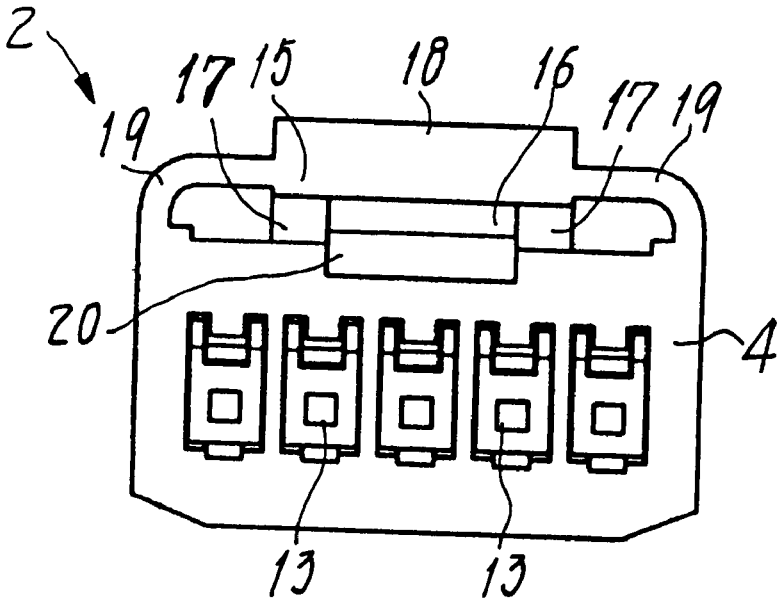
FIG. 5 is a rear elevation of the female housing.

The male housing 3 is shaped generally as a parallelepiped box having a fore end opening, and insert-molded such that a plurality of pin contacts 6 penetrate its bottom 5 (see FIG. 2). The male housing 3 has on its outer surface a slope 8 slanted forwards and downwards and a shoulder 9 vertically extending downwards from the rear end of the slope, so that those slope 8 and shoulder 9 define together a generally upright lockable lug 7. A guide tongue 10 continuing forwards from the frontal face of the lockable lug 7 intervenes between side slots 11 that arc disposed beside this guide tongue. These guide tongue 10 and side slots 11 will come into engagement with hinge-shaped legs 17, which are formed in the female housing 4 as will be detailed below.

On the other hand, the female housing 4 is also a parallelepiped to be fitted in the male housing 3. Penetrating the female housing 4 and corresponding to the male connector's 1 pin contacts 6 are a plurality of compartments 13 that extend fore and aft to receive therein the socket contacts 22 (see FIG. 6). Those socket contacts will have been crimped on respective wire ends 21 as shown in FIG. 6. Formed on the outer surface of the female housing 4 is a flat-shaped lock arm 15 such that two elastically deforming hinge-shaped legs 17 integral therewith serve to secure this arm on the outer surface of the female housing. The lock arm 15 has a hook-shaped pawl 16 that is disposed at the free end of this arm so as to engage with the lockable lug 7 of the male housing 3. A push lever 18 protruding upwards is formed at the rear end of the lock arm 15 extending backward beyond the hinge-shaped legs 17. The push lever 18 will be pressed down by the operator with his or her finger(s) so that the lock arm 15 will pivot on the hinge-shaped legs. Further, both the lateral ends of the push lever 18 arc firmly adjoined to a pair of elastically deformable bridges 19 that continue integrally from the respective side walls of female housing 4. In detail, the bridges 19 extend sideways and outwards at first from the respective ends of push lever 18, and then curve downwards to be integral with the side walls of the female housing. The push lever 18 is in such a relationship with the bridges 19 as to form an arch-shaped lock guard above the rear end of female housing. A loop is thus defined by and along the push lever 18, the body of the female housing 4 and the pair of bridges 19 will serve as the guard for this lever. By virtue of this loop, no foreign piece or article can come in between the lever 18 and the body of female housing. Formed between the two hinge-shaped legs 17 separated sideways from each other is a guide groove 20 for receiving and engaging with the guide tongue 10. By employing those hinge-shaped legs 17 and bridges 19 all of a proper bending strength (resiliency), the rigidity of push lever 18 may be raised as a whole to improve mutual retention and mechanical strength of the housings 3 and 4 interlocked with each other. However, flexibility of the push lever, thus easiness of operation when engaging the male housing 3 with or disengaging it from female housing, should be not impaired by such a raised rigidity of push lever 18.

FIG. 6 shows the connector assembly in use, wherein the male and female connectors 1 and 2 of the described structure are engaged with each other. The male connector 1 is surface-mounted on a printed circuit board 31, by soldering its pin contacts 6 thereto. The female housing 4 of female connector 2 having their socket contacts 22 crimped on wire ends 21 will be inserted into the male housing 3 of male connector 1. Consequently, each pin contact 6 will fit in the corresponding socket contact 22 to establish electric connection between them. At the same time, the pawl 16 of lock arm 15 will engage with the lockable lug 7 of male housing 3 to thereby latch the female housing 4 in the male housing. In detail, the guide tongue 10 of male housing 3 will simultaneously be brought into engagement with the guide groove 20 disposed between hinge-shaped legs 17, with the side slots 11 advancing forwards to fit on them. On the other hand, the pawl 16 of lock arm 15 moves on and along the slope 8 of lockable lug 7, with this arm pivoting outwards on the hinge-shaped legs 17. Such an outward pivoting of the lock arm 15 will allow the pawl 16 to slide over the slope 8, causing elastic recovery of the arm 15 to bring the shoulder 9 of the lockable lug 7 into a normally non-releasable engagement with the pawl 16. A click occurring when the female housing 4 snaps in male housing 3 will facilitate the user or operator to detect establishment of a correct mutual interlocking position of these housings.

Figure 7:
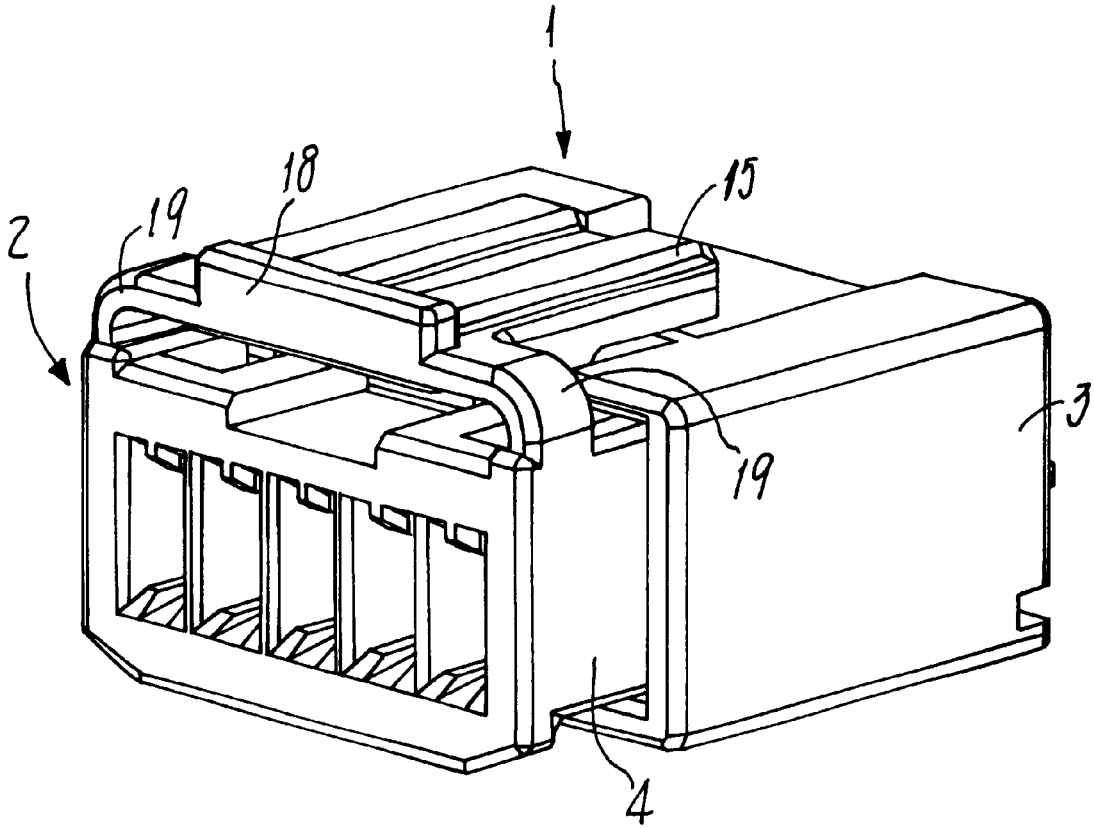
FIG. 7 is a perspective view of the male and female housings engaged with each other.
Figure 8:
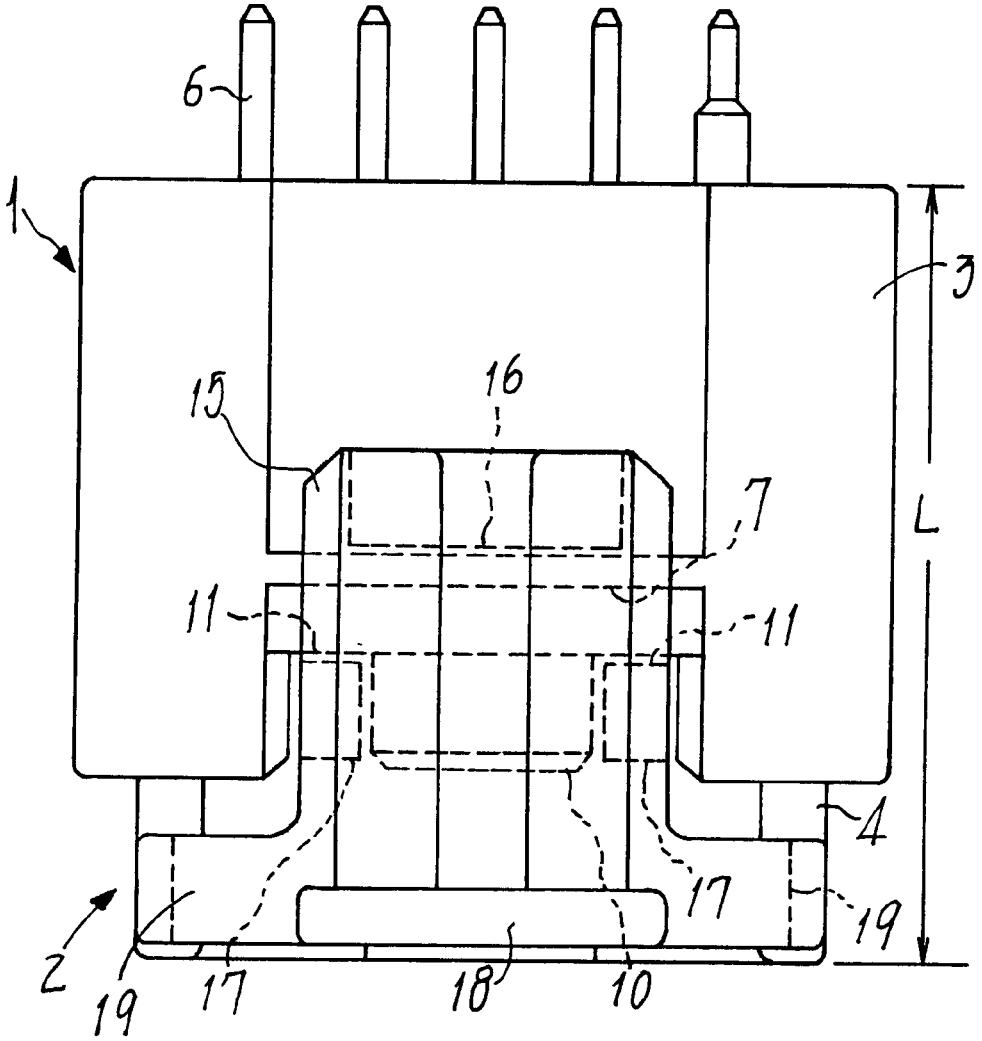
FIG. 8 is a plan view of the male and female housings engaged with each other.

FIGS. 7 and 8 show the male and female housings 3 and 4 engaged with each other. It will be apparent there that the guide tongue 10 of male housing 3 takes its position between the hinge-shaped legs 17, when the side slots 11 fit on them to allow the female housing 4 to be fully inserted in the male housing. Such a deepest position of the female housing almost entirely received in male housing 3 will now minimize the overall length 'L' of this connector assembly. The housings 3 and 4 thus firmly latched on or in each other will surely resist any external force such as a wrenching one or the like possibly applied thereto. The lock arm 15 is thus protected from any unintentional deformation or release, and also the pin contacts 6 and socket contacts 22 are guarded from deformation.

The female housing 4 may be disengaged from the male housing 3, if necessary after or during use of the electronic or electric device. In this case, the user or operator just presses the push lever 18 to elastically deform the bridges 19 so as to swing the lock arm 15 outwards a little angle around the hinge-shaped legs 17. As a result, the pawl 16 will be freed from the lockable lug 7, making it possible to unlock and pull the female housing 4 out of male housing 3.

In summary, the lock arm in the present invention described above is held in place by the elastically deforming hinge-shaped legs and bridges, the latter being disposed respectively on and continuing from the opposite ends of the push lever. The hinge-shaped legs and the bridges can be designed to be of a proper bending strength (resiliency) to raise rigidity of the push lever to such a degree that the connectors can still be engaged easily with and disengaged smoothly from each other. By virtue of this feature, mutual retention and holding strength of the connectors are now improved on one hand, and the clicking of them being snugly fitted one in another can now be more clearly detected by the user or operator.

Further, the bridges having their one ends connected to lateral sides of the push lever do have their other ends made integral with the side walls of the housing body. The arch-shaped lock guard thus formed above the rear end of said housing body does provide a loop extending through the push lever and the housing body. This loop will not only guard the push lever but also will prevent the wire ends of another harness from catching and/or moving the push lever to undesirably release the lock arm.

Besides the features summarized above, the present connector assembly has a further feature. Insofar as the male and female connectors are in engagement with each other, the guide tongue of male housing takes its position between the hinge-shaped legs of female housing, with the side slots fitting on them thus minimizing effective length of the assembly whose connectors are latched in this manner. The connector assembly of the invention is now rendered smaller in its overall size and more resistant to external forces such as a wrenching one possibly applied thereto.

What is claimed is:

1. A connector assembly composed of connectors and having an interlocking system, the connectors being a male connector having a male housing and a female connector having a female housing, the interlocking system comprising:

a lockable lug formed on an outer surface of the male housing, a lock arm having a locking pawl extending downwardly at one end thereof and engageable with the lockable lug, the lock arm being formed on an outer surface of the female housing, a pair of elastically deforming hinge-shaped legs each having opposite ends, one of the ends being integral with an outer surface of the female housing, with the other end being formed on the lock arm, and a push lever disposed at a rear end of the lock arm extending rearwards beyond the hinge-shaped legs, wherein the male housing further comprises a guide tongue and a pair of side slots, the guide tongue protruding forwards from the lockable lug and intervening between the side slots, and wherein the guide tongue of the male housing is capable of insertion in between the two hinge-shaped legs spaced sideways from each other in the female housing, with the side slots simultaneously fitting on the legs, the female housing further comprising a pair of elastically deformable bridges being formed on opposite side walls of the female housing so as to be integral with lateral ends of the push lever.

2. A connector assembly as defined in claim 1, wherein the male housing is a rectangular parallelepiped, and a plurality of pin contacts held in the male connector protrude into a cavity that is defined in the parallelepiped so as to have a fore end opening, and wherein the female housing is a further parallelepiped fitting in the cavity of the male housing, and a plurality of compartments are formed in the female housing so as to correspond to the pin contacts so that socket contacts secured on respective wire ends and accommodated in the respective compartments are isolated from each other.

3. A connector assembly as defined in claim 1, wherein the hinge-shaped legs of the female housing are located inside the respective and corresponding bridges continuing to the lateral ends of the push lever so as to match the side slots.

* * * * *